US009530384B2

(12) United States Patent
Saitoh et al.

(10) Patent No.: US 9,530,384 B2
(45) Date of Patent: Dec. 27, 2016

(54) DISPLAY DEVICE THAT COMPENSATES FOR CHANGES IN DRIVING FREQUENCY AND DRIVE METHOD THEREOF

(71) Applicant: Sharp Kabushiki Kaisha, Osaka-shi, Osaka (JP)

(72) Inventors: Kohji Saitoh, Osaka (JP); Akihisa Iwamoto, Osaka (JP); Tomohiko Nishimura, Osaka (JP); Masaki Uehata, Osaka (JP); Jun Nakata, Osaka (JP); Masami Ozaki, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 0 days.

(21) Appl. No.: 14/439,722

(22) PCT Filed: Nov. 8, 2013

(86) PCT No.: PCT/JP2013/080216
§ 371 (c)(1),
(2) Date: Apr. 30, 2015

(87) PCT Pub. No.: WO2014/077194
PCT Pub. Date: May 22, 2014

(65) Prior Publication Data

US 2015/0279333 A1 Oct. 1, 2015

(30) Foreign Application Priority Data

Nov. 14, 2012 (JP) ..... 2012-250039

(51) Int. Cl.
*G09G 5/00* (2006.01)
*G09G 5/18* (2006.01)
(Continued)

(52) U.S. Cl.
CPC *G09G 5/18* (2013.01); *G09G 3/20* (2013.01); *G09G 3/36* (2013.01); *G09G 3/3648* (2013.01);
(Continued)

(58) Field of Classification Search
CPC ..... G09G 3/36; G09G 3/20; G09G 5/00; G06F 3/038; G05F 1/00; G05F 1/70
See application file for complete search history.

(56) References Cited

U.S. PATENT DOCUMENTS 8,654,044 B2 * 2/2014 Inoue ..... G09G 3/2014 313/463
2002/0041281 A1 * 4/2002 Yanagi ..... G09G 3/3648 345/212
(Continued)

FOREIGN PATENT DOCUMENTS

JP 2-309318 A 12/1990
JP 2002-116739 A 4/2002
(Continued)

OTHER PUBLICATIONS

English translation of Official Communication issued in corresponding International Application PCT/JP2013/080216, mailed on Dec. 24, 2013.

*Primary Examiner* — Pegeman Karimi
(74) *Attorney, Agent, or Firm* — Keating & Bennett, LLP

(57) ABSTRACT

In a display device that can use a low frequency drive method, in the case of low frequency drive, in a data correction unit (23) of a display control circuit (200), a pixel grayscale value is set such that the differential value between the potential difference between the pixel electrode and the common electrode when a voltage of positive polarity is applied and the potential difference between the pixel electrode and the common electrode when a voltage of negative polarity is applied becomes larger than during normal drive.
(Continued)

With this, a correction amount (shift amount) is made larger during low frequency drive than during normal drive, whereby flickers and ghosting during low frequency drive are prevented.

14 Claims, 9 Drawing Sheets

(51) Int. Cl.
*G09G 3/20* (2006.01)
*G09G 3/36* (2006.01)

(52) U.S. Cl.
CPC .... *G09G 3/3696* (2013.01); *G09G 2320/0247* (2013.01); *G09G 2320/0285* (2013.01); *G09G 2320/046* (2013.01)

(56) References Cited

U.S. PATENT DOCUMENTS

| | | | | |
|---|---|---|---|---|
| 2008/0074358 | A1* | 3/2008 | Ogawa | G09G 3/3233 345/76 |
| 2008/0218462 | A1* | 9/2008 | Murai | G09G 3/3611 345/89 |
| 2009/0058763 | A1* | 3/2009 | Doi | G09G 3/3688 345/55 |
| 2011/0234960 | A1* | 9/2011 | Nishida | G02F 1/133734 349/139 |

FOREIGN PATENT DOCUMENTS

| | | | |
|---|---|---|---|
| JP | 2008-216859 | A | 9/2008 |
| JP | 2009-58675 | A | 3/2009 |

* cited by examiner

| FREQUENCY INFORMATION | | | 60 Hz | 30 Hz |
|---|---|---|---|---|
| VIDEO SIGNAL VOLTAGE | POSITIVE POLARITY | V255 | 7.757 V | 7.707 V |
| | | V224 | 6.848 V | 6.808 V |
| | | V192 | 6.427 V | 6.427 V |
| | | V128 | 5.922 V | 5.922 V |
| | | V64 | 5.506 V | 5.506 V |
| | | V32 | 5.294 V | 5.294 V |
| | | V0 | 4.272 V | 4.272 V |
| | NEGATIVE POLARITY | V0 | 3.985 V | 3.985 V |
| | | V32 | 2.997 V | 2.997 V |
| | | V64 | 2.759 V | 2.759 V |
| | | V128 | 2.311 V | 2.311 V |
| | | V192 | 1.760 V | 1.760 V |
| | | V224 | 1.301 V | 1.261 V |
| | | V255 | 0.428 V | 0.378 V |

DISPLAY DEVICE THAT COMPENSATES FOR CHANGES IN DRIVING FREQUENCY AND DRIVE METHOD THEREOF

TECHNICAL FIELD

The present invention relates to an active matrix type of display device and a drive method thereof. More specifically, the present invention relates to a display device that can be driven at a low frequency lower than 60 Hz and a diving method thereof.

BACKGROUND ART

In general, in a liquid crystal display device, AC drive is performed to suppress deterioration of a liquid crystal and maintain display quality. However, in an active type of liquid crystal display device, the characteristic of a switching element such as a thin film transistor (TFT) provided for each pixel is not sufficient, whereby the transmittance of a liquid display layer is not completely symmetrical with respect to the positive and negative data voltages even when the positive or negative of a video signal output from a video signal line drive circuit applying a voltage to a video signal line (column electrode) of a liquid crystal panel (also referred to "column electrode drive circuit" or "data driver circuit"), that is, the positive or negative of an applied voltage using the potential of a common electrode as a reference is symmetrical. For this reason, with a drive method inverting (using the potential of the common electrode as a reference) the polarity of an applied voltage to a liquid crystal for each frame (frame inversion drive method), a flicker occurs in the display of the liquid crystal panel (hereinafter, this flicker is also referred to as "flicker due to positive/negative asymmetry"). In recent years, especially for a mobile information device such as a mobile phone, high-quality display performance is demanded due to improved processing performance and more sophisticated use thereof, and such a flicker due to positive/negative asymmetry thus has been a problem. With this background, as an AC drive method of a liquid crystal module used in a mobile information device as described above, a drive method, in which positive and negative polarities of an applied voltage are inverted for each horizontal scanning line, and at the same time, the positive and negative polarities for each frame are inverted (referred to as "one-line inversion drive method"), is employed. Furthermore, a drive method, in which positive and negative polarities of an applied voltage are inverted for each pixel adjacent to one another in the vertical and the horizontal directions, and at the same time, the positive and negative polarities are inverted for each frame (referred to as "one-dot inversion drive method"), is also employed in some cases.

However, when the one-line inversion drive method described above is employed, although high-quality display can be performed, the frequency of polarity inversion in a video signal to be applied to a liquid crystal panel is increased (the inversion frequency becomes higher). Furthermore, the switching frequency of the potential of the common electrode also becomes higher because of reduced withstand pressure required for a drive integrated circuit (IC), whereby the power consumption is increased. If the one-dot inversion drive method is employed, inversion drive of the common electrode is impossible and the withstand pressure required for a drive IC is thus increased, whereby the production cost of the device is raised and the power consumption is increased.

With this background, in the recent years, a low frequency drive method in which the inversion frequency is lowered than normally and a drive method in which a scanning stop period is provided so that the applied voltage is in an unchanged state for a predetermined period of time, thereby lowering the overall inversion frequency (referred to as a pause drive method) are employed in some cases. It should be noted that the pause drive method also is a drive method in which the inversion frequency is substantially lowered, and thus can be considered as a low frequency drive method in a broad sense. The low frequency drive method thus can reduce the number of times of drive for each unit time. The pause drive method, in particular, stops driving during the scanning stop period (retention period), thereby responding to the requirements of reducing power consumption in a mobile phone and other devices.

However, in a capacitance element for retaining an applied voltage provided on a pixel forming unit of a liquid crystal panel, during the time to the next data rewriting point in the case of the low frequency drive, and during the scanning stop period in the case of the pause drive, a current leakage occurs, whereby the voltage to be retained is lowered. With this, luminance change becomes prominent in a pixel displayed in accordance with an applied voltage provided next (in the case where the luminance should be the same). As a result, this luminance change becomes visible as a flicker (hereinafter, this flicker is also referred to as "flicker due to a current leakage").

Furthermore, in a scanning period, each row of the pixel forming units of the liquid crystal panel are sequentially selected and receive an applied pixel voltage. At this time, until the pixel voltage of the pixel forming unit becomes the applied voltage, that is, until writing of data is completed, a predetermined period of time (in a selected period) is required. If the voltage changes via a parasitic capacitor during the time, the luminance of the pixel displayed also changes. If the amount of this luminance change varies depending on the frame, for example, the luminance change can be visible as a flicker (hereinafter, this flicker is also referred to as "flicker due to data writing").

Furthermore, in the scanning period, after the data has been written into the selected pixel forming unit, due to potential variations of a scanning signal line and a video signal line connected to an adjacent or neighboring pixel forming unit, the retained applied voltage can change via a parasitic capacitor formed between (a pixel electrode being an end of) a capacitance element of the pixel forming unit and these signal lines (this phenomenon is also referred to as "pulling due to a parasitic capacitor"). With this, luminance change becomes prominent in a pixel displayed in accordance with an applied voltage provided next. As a result, this luminance change can be visible as a flicker (hereinafter, this flicker is also referred to as "flicker due to pulling").

When it is assumed that drive is performed with the positive and negative polarities inverted for each frame, the flicker as described above is generated by equalization of the absolute value of the positive polarity applied voltage with respect to the liquid crystal and the absolute value of the negative polarity applied voltage. This indicates that a DC voltage (direct current component) is applied to the liquid crystal as a result. Especially when the same DC voltage continues to be applied to the liquid crystal, that is, when the same image continues to be displayed, it is known that an afterimage phenomenon referred to as "ghosting" is generated.

Furthermore, it is known that generation of the "ghosting" described above is prominent when a drive method is employed in which alignment of liquid crystal molecules is controlled by generating an electric field of which the direction is along a substrate with respect to a liquid crystal layer (referred to as transverse field method). This is because the electrode structure of a liquid crystal display element in the transverse field method is formed asymmetrically in the vertical direction, and a residual DC voltage is thus easily generated in the vertical direction, compared with a conventional drive method in a TN mode in which the electrode structure is symmetrically formed.

Furthermore, out of various transverse field methods, compared with an in-plane switching (IPS) method, the electrode structure of a fringe-field switching (FFS) method is more complicated because the face heights of two electrodes with respect to the substrate face are different and more residual DC voltages are likely to be generated.

Japanese Unexamined Patent Application Publication No. 2008-216859 discloses a structure of an FFS liquid crystal display device that prevents ghosting by correcting a signal given to two electrodes such that the potential difference between electrodes in the case where a first electrode being one of two electrodes has a potential higher than a second electrode being the other electrode becomes larger than that in the case where the first electrode has a potential lower than the second electrode.

CITATION LIST

Patent Literature

PTL 1: Japanese Unexamined Patent Application Publication No. 2008-216859

SUMMARY OF INVENTION

Technical Problem

According to Japanese Unexamined Patent Application Publication No. 2008-216859 described above or other related conventional techniques, compensation to be performed to prevent flickers (due to a factor other than current leakage) and ghosting in a liquid crystal display device with a low frequency drive method including the pause drive method is not especially indicated.

However, the drive frequency of a liquid crystal display device is not unrelated to the compensation described above. In particular, the case of a liquid crystal display device employing a transverse field method and also employing a low frequency drive method is different from the case in which drive is performed at a normal frequency, in view of flickers and ghosting.

The present invention has been made in light of the above-described circumstances, and an object of the present invention is to provide a display device capable of performing compensation suitable for prevention of flickers and ghosting when a low frequency drive is performed in a display device in which a low frequency drive method can be employed.

Solution to Problem

A first aspect of the present invention provides an active matrix type of display device. The display device according to the first aspect of the present invention includes a plurality of pixel forming units that form an image to be displayed and include a pixel electrode and a common electrode provided in a manner corresponding to the pixel electrode to apply a voltage between the pixel electrode and the common electrode, a plurality of video signal lines for communicating a plurality of video signals indicating the image to be displayed to the pixel forming units, and a plurality of scanning signal lines crossing the video signal lines. The pixel forming units are associated with the video signal lines and the scanning signal lines and disposed in a matrix form. The display device includes a scanning signal line drive circuit that selectively drives the scanning signal lines, a video signal line drive circuit that gives the video signals to be communicated to the video signal lines, a common electrode drive circuit that sets a voltage to be applied to the common electrode, and a display control circuit that controls the scanning signal line drive circuit, the video signal line drive circuit, and the common electrode drive circuit by giving a predetermined control signal thereto. The display control circuit controls the video signal line drive circuit and the common electrode drive circuit such that the polarity of a voltage applied to the pixel electrode based on the potential of the common electrode as a reference is inverted for each predetermined period and a differential value between the potential difference between the pixel electrode and the common electrode when a voltage of positive polarity is applied and the potential difference between the pixel electrode and the common electrode when a voltage of negative polarity is applied is set larger when the image to be displayed is rewritten in a frame period having a second length longer than a first length than when the image to be displayed is rewritten in a frame period having the first length.

According to a second aspect of the present invention, the display control circuit in the first aspect of the present invention controls the common electrode drive circuit such that a voltage of the common electrode is adjusted such that the differential value becomes larger when the common electrode is driven with the second length than when the common electrode is driven with the first length.

According to a third aspect of the present invention, the display control circuit in the first aspect of the present invention controls the video signal line drive circuit such that a voltage applied to the pixel electrode is adjusted such that the differential value becomes larger when the video signal line is driven with the second length than when the video signal line is driven with the first length.

According to a fourth aspect of the present invention, the display control circuit in the third aspect of the present invention controls the video signal line drive circuit such that a voltage applied to the pixel electrode is adjusted such that the differential value becomes larger in the vicinity of a highest value of display grayscale indicated by the video signal.

According to a fifth aspect of the present invention, the display control circuit in the third aspect of the present invention controls the video signal line drive circuit such that a voltage applied to the pixel electrode is adjusted such that the larger display grayscale indicated by the video signal, the larger the differential value.

According to a sixth aspect of the present invention, the display control circuit in the third aspect of the present invention stores therein an adjustment amount for adjusting a voltage applied to the pixel electrode as table information associated with display grayscale corresponding to the video signal.

According to a seventh aspect of the present invention, the display control circuit in the six aspect of the present invention includes a drive frequency switching circuit that switches between a first case rewriting the image to be displayed in a frame period having the first length and a second case rewriting the image to be displayed in a frame period having the second length. The table information includes first table information storing therein the adjustment amount in the first case and second table information storing therein the adjustment amount in the second case.

According to an eighth aspect of the present invention, the pixel forming unit in the first aspect of the present invention includes a thin film transistor that is brought into a conductive state or an interrupted state in accordance with a signal applied to a scanning signal line connected thereto, a pixel electrode connected to a video signal line connected thereto via the thin film transistor, a pixel capacitor formed by the pixel electrode and the common electrode, and a liquid crystal element that displays a pixel in display grayscale in accordance with a voltage retained by the pixel capacitor.

According to a ninth aspect of the present invention, the thin film transistor in the eighth aspect of the present invention includes a semiconductor layer consisting of an oxide semiconductor.

According to a tenth aspect of the present invention, the oxide semiconductor in the ninth aspect of the present invention contains indium, gallium, and zinc as principal components.

According to an eleventh aspect of the present invention, in the pixel forming units in the eighth aspect of the present invention, the pixel electrode and the common electrode are disposed so as to be in a liquid crystal mode of a transverse field method with respect to the liquid crystal element.

A twelfth aspect of the present invention provides an electronic device that includes the display device disclosed in the first aspect of the present invention.

A thirteen aspect of the present invention provides a method of driving an active matrix type of display device including a plurality of pixel forming units that form an image to be displayed and include a pixel electrode and a common electrode provided in a manner corresponding to the pixel electrode to apply a voltage between the pixel electrode and the common electrode, a plurality of video signal lines for communicating a plurality of video signals indicating the image to be displayed to the pixel forming units, and a plurality of scanning signal lines crossing the video signal lines. The pixel forming units are associated with the video signal lines and the scanning signal lines and disposed in a matrix form. The method includes a scanning signal line drive step of selectively driving the scanning signal lines, a video signal line drive step of giving the video signals to be communicated to the video signal lines, a common electrode drive step of setting a voltage to be applied to the common electrode, and a display control step of controlling the scanning signal line drive step, the video signal line drive step, and the common electrode drive step by giving a predetermined control signal thereat. The display control step controls the video signal line drive step and the common electrode drive step such that the polarity of a voltage applied to the pixel electrode based on the potential of the common electrode as a reference is inverted for each predetermined period and the differential value between the potential difference between the pixel electrode and the common electrode when a voltage of positive polarity is applied and the potential difference between the pixel electrode and the common electrode when a voltage of negative polarity is applied is set larger when the image to be displayed is rewritten in a frame period having a second length longer than a first length than when the image to be displayed is rewritten in a frame period having the first length.

Advantageous Effects of Invention

According to the first aspect of the present invention, the differential value between the potential difference between the pixel electrode and the common electrode when a voltage of positive polarity is applied and the potential difference between the pixel electrode and the common electrode when a voltage of negative polarity is applied is set larger when drive is performed in a frame period having a second length such as during low frequency drive than when drive is performed in a frame period having a first length such as during normal drive. With this, a correction amount (shift amount) can be larger during low frequency drive than during normal drive, whereby compensation can be performed that is suitable for prevention of flickers and ghosting during low frequency drive.

According to the second aspect of the present invention, with the common electrode drive circuit, setting can be easily performed to make the differential values large collectively.

According to the third aspect of the present invention, with the video signal drive circuit, setting can be easily performed to make the differential values large with respect to each pixel electrode.

According to the fourth aspect of the present invention, adjustment is made such that the differential value becomes large in the vicinity of the highest value of display grayscale. With this, compensation can be performed that is more suitable for prevention of flickers and ghosting.

According to the fifth aspect of the present invention, the voltage applied to the pixel electrode is adjusted, whereby more accurate compensation can be performed in accordance with grayscale.

According to the six aspect of the present invention, the adjustment amount can be stored in a simple manner as table information associated with display grayscale corresponding to the video signals.

According to the seventh aspect of the present invention, suitable compensation can be performed by selecting appropriate table information in accordance with switching of drive modes.

According to the eighth aspect of the present invention, compensation can be performed that is suitable for prevention of flickers and ghosting in a liquid crystal element during low frequency drive.

According to the ninth aspect of the present invention, compensation can be performed that is suitable for the case of an oxide semiconductor requiring prevention of flickers and ghosting during lower frequency drive.

According to the tenth aspect of the present invention, more suitable compensation can be performed because of use of In—Ga—Zn—O type as an oxide semiconductor.

According to the eleventh aspect of the present invention, compensation can be performed that is suitable for the case of a transverse field method requiring prevention of flickers and ghosting during lower frequency drive.

According to the twelfth aspect of the present invention, the same effect as in the first aspect of the present invention can be achieved in an electronic device.

According to the thirteenth aspect of the present invention, the same effect as in the first aspect of the present invention can be achieved in a drive method of a display device.

DESCRIPTION OF EMBODIMENTS

An embodiment of the present invention will be described below with reference to the attached drawings.

<1. Overall Structure and Operation of Liquid Crystal Display Device>

Figure 1:
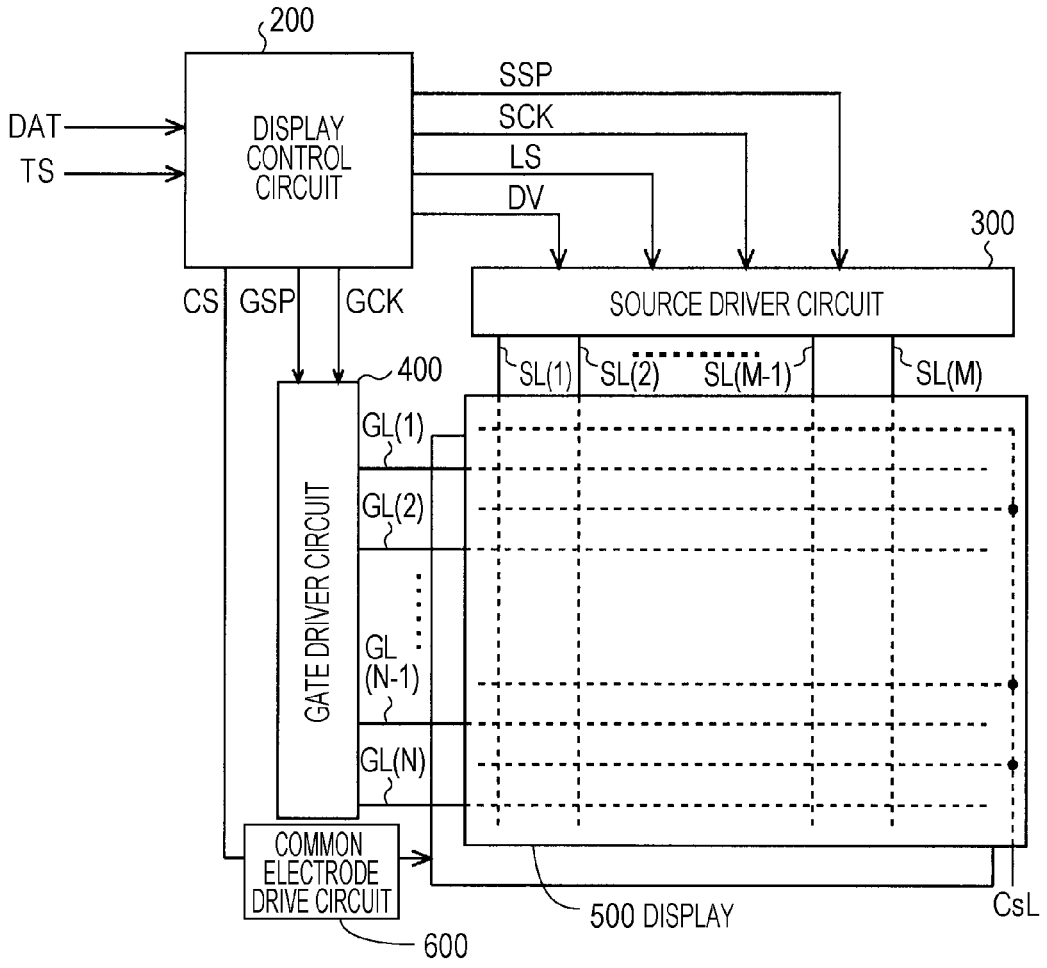
FIG. 1 is a block diagram illustrating the overall structure of an active matrix type of liquid crystal display device according to an embodiment of the present invention.

FIG. 1 is a block diagram illustrating the overall structure of an active matrix type of liquid crystal display device according to an embodiment of the present invention. This liquid crystal display device includes a drive control portion consisting of a display control circuit 200, a source driver circuit (video signal line drive circuit) 300, and a gate driver circuit (scanning signal line drive circuit) 400, a display 500, and a common electrode drive circuit 600. This display device is to be included in a terminal device such as a mobile phone and all kinds of electronic devices including a display such as a computer and a digital camera.

The display 500 includes a plurality of (M) video signal lines SL(1) to SL(M), a plurality of (N) scanning signal lines GL(1) to GL(N), and a plurality of pieces (M×N pieces) of pixel forming units provided along the video signal lines SL(1) to SL(M) and the scanning signal lines GL(1) to GL(N).

This display 500 is a twisted nematic (TN) alignment type and structured to be a normally white type. As the drive method thereof, a frame inversion method is used. However, this is merely an example, and other alignment types such as the IPS method and the FFS method and the line inversion drive method described above may be used.

As described above, the liquid crystal mode (liquid crystal alignment type) and the drive method of the display 500 are not limited. However, a display using a transverse field method such as in the case of the IPS mode and the FFS mode, a residual DC voltage is generated in the vertical direction more easily than in the case of the TN mode. The reason for this is thought to be the electrode structure thereof formed asymmetrically in the vertical direction and easily inducing polarization due to a flexo-electric effect. With this, the usability of the effects of the present embodiment as described later is increased, and it thus can be said that the present embodiment is more suitable.

Figure 2:
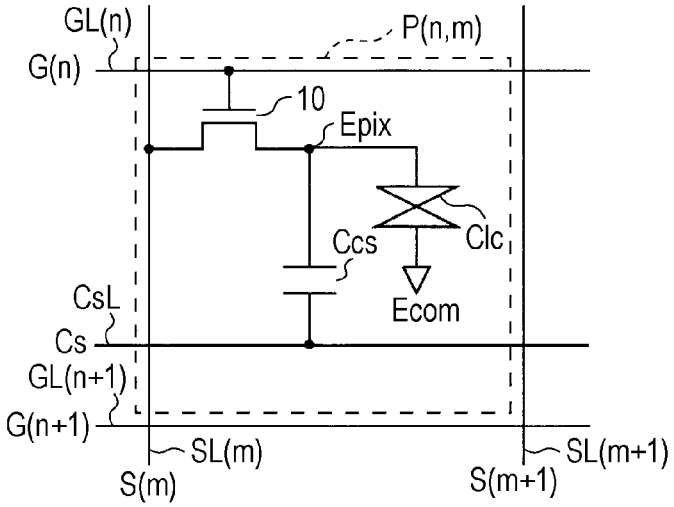
FIG. 2 is a circuit diagram illustrating an equivalent circuit of a pixel forming unit in the embodiment described above.

In the description below, in association with the intersection of the scanning signal line GL(n) and the video signal line SL(m), the pixel forming unit provided in the vicinity of the intersection (in the figure, in the vicinity of the lower right of the intersection) is represented by a reference character "P(n,m)". FIG. 2 illustrates an equivalent circuit of the pixel forming unit P(n,m) in the display 500 according to the present embodiment.

As illustrated in FIG. 2, each pixel forming unit P(n,m) includes a TFT 10 being a switching element in which the gate terminal thereof is connected to the scanning signal line GL(n) and the source terminal thereof is connected to the video signal line SL(m) passing through the intersection, a pixel electrode Epix connected to the drain terminal of the TFT 10, a common electrode Ecom commonly provided on the pixel forming units P(i,j) (i=1 to N, j=1 to M), and a liquid crystal layer as an electrooptical element commonly provided on the pixel forming units P(i,j) (i=1 to N, j=1 to M) and sandwiched between the pixel electrode Epix and the common electrode Ecom.

In the present embodiment, in the TFT 10 described above, an oxide semiconductor of which the response is relatively quick and a current leakage is very small, typically an In—Ga—Zn—O type oxide semiconductor is to be used in a semiconductor layer. Naturally, when the quick response and the small current leakage are not demanded so much, an amorphous silicon which can be produced easily and at a low cost may be used as the semiconductor layer, and other publicly known materials such as a continuous grain boundary silicon also may be used.

Figure 3:
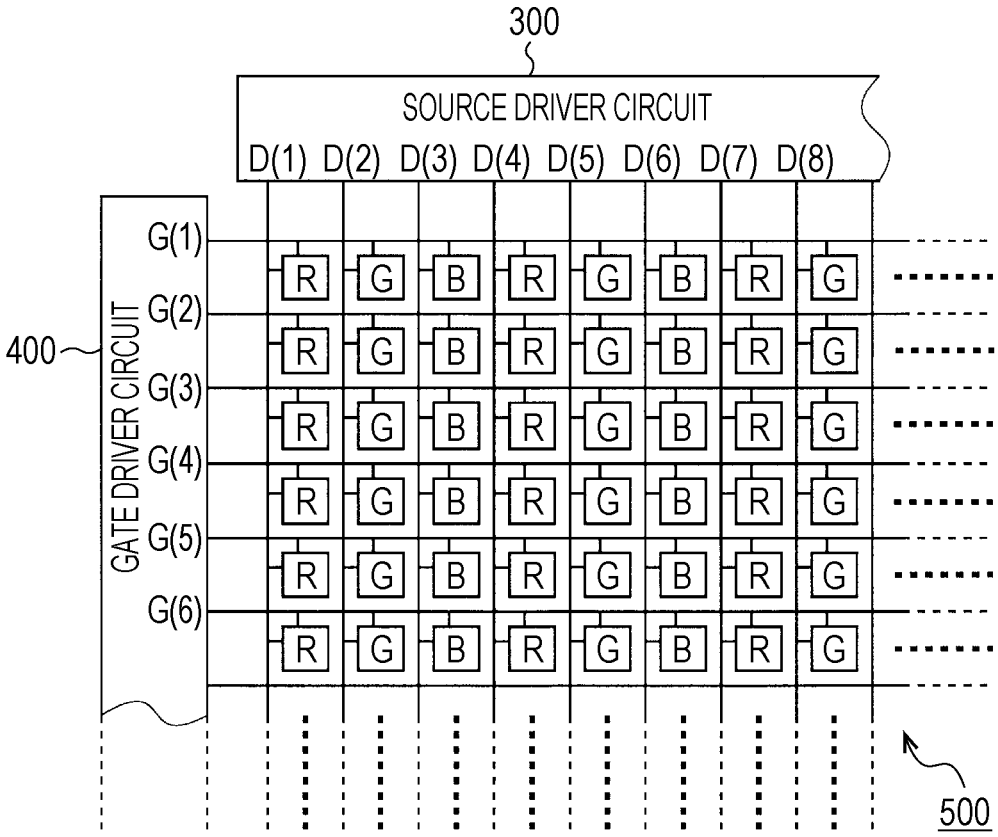
FIG. 3 is a diagram illustrating a display color of each pixel forming unit.

In FIG. 3, each of the characters "R", "G", and "B" assigned to each pixel forming unit P(n,m) indicates what color is displayed by that pixel forming unit P(n,m), among "red", "green", and "blue". Actually, the pixel of each color among RGB formed by each pixel forming unit of RGB is to be one set to form one color pixel.

In each pixel forming unit P(n,m), a liquid crystal capacitor (also referred to as "pixel capacitor") Clc is formed by the pixel electrode Epix and the common electrode Ecom facing the pixel electrode Epix with the liquid crystal layer sandwiched therebetween. In the vicinity of the pixel electrode Epix, two video signal lines SL(m) and SL(m+1) are arranged, out of which the video signal line SL(m) is connected to that pixel electrode Epix via the TFT 10. Between the pixel electrode Epix of the pixel forming unit thus noted and the video signal line SL(m+1) adjacent thereto, and between that pixel electrode Epix and two scanning signal lines GL(n) and GL(n+1) adjacent thereto, a parasitic capacitor is present respectively. Furthermore, in parallel with the scanning signal line GL(n), an auxiliary capacitor line CsL is formed, and in each pixel forming unit P(n,m), an auxiliary capacitor Ccs is formed between the pixel electrode Epix and the auxiliary capacitor line CsL. It should be noted that the full capacity formed between the pixel electrode Epix and other electrodes in one pixel forming unit P(n,m) (that is, the full capacity connected to the pixel electrode Epix) is also referred to as a pixel capacitor.

The display control circuit 200 receives a display data signal DAT and a timing control signal TS sent from the outside and outputs a digital image signal DV, a source start pulse signal SSP for controlling the timing of causing the display 500 to display an image, a source clock signal SCK, a latch strobe signal LS, a gate start pulse signal GSP, a gate clock signal GCK, and a common potential control signal CS that controls the potential setting (switching of two kinds of potentials depending on the case) of the common electrode drive circuit 600.

The gate driver circuit 400 sequentially applies active scanning signals G(1) to G(N) to each of the scanning signal lines GL(1) to GL(N) based on the gate start pulse signal GSP and the gate clock signal GCK output from the display control circuit 200.

The source driver circuit 300 receives the digital image signal DV, the source start pulse signal SSP, the source clock signal SCK, and the latch strobe signal LS output from the display control circuit 200 and applies drive video signals S(1) to S(M) to each of the video signal lines SL(1) to SL(M) to charge the pixel capacitor (the liquid crystal capacitor Clc and the auxiliary capacitor Ccs) of each pixel forming unit P(n,m) in the display 500. At this time, in the source driver circuit 300, in the timing that a pulse of the source clock signal SCK is generated, the digital image signal DV indicating the voltage to be applied to each of the video signal lines SL(1) to SL(M) is sequentially retained. Thereafter, in the timing that a pulse of the latch strobe signal LS is generated, the retained digital image signal DV is converted into an analog voltage. D/A conversion as described above is performed by a grayscale voltage generation circuit.

This grayscale voltage generation circuit generates an analog voltage corresponding to each display grayscale by dividing a reference voltage for generating a grayscale voltage given by the outside of the source driver circuit 300, for example. Analog voltages generated by this grayscale voltage generation circuit are applied to all the video signal lines SL(1) to SL(M) as drive video signals all at once. In other words, in the present embodiment, a line sequential drive method is used as the drive method of the video signal lines SL(1) to SL(M).

The frame inversion drive method is used here which is a drive method in which the positive and negative polarities of an applied voltage to a pixel liquid crystal are inverted for each frame by the common electrode drive circuit 600. However, as described later, a line inversion drive method may be used which is a drive method in which the positive and negative polarities of an applied voltage to a pixel liquid crystal are inverted for each row in the display 500 and also inverted for each frame.

As described above, the drive video signals are applied to the video signal lines SL(1) to SL(M) and the scanning signals are applied to the scanning signal lines GL(1) to GL(N), whereby an image is displayed on the display 500. It should be noted that the common electrode Ecom and the auxiliary capacitor line CsL are supplied with a predetermined voltage by a power source circuit, which is not illustrated, to be retained at the same potential. However, the auxiliary capacitor line CsL may be driven so as to be at a potential the same as or different from the common electrode Ecom.

<2. Display Control Circuit>

Figure 4:
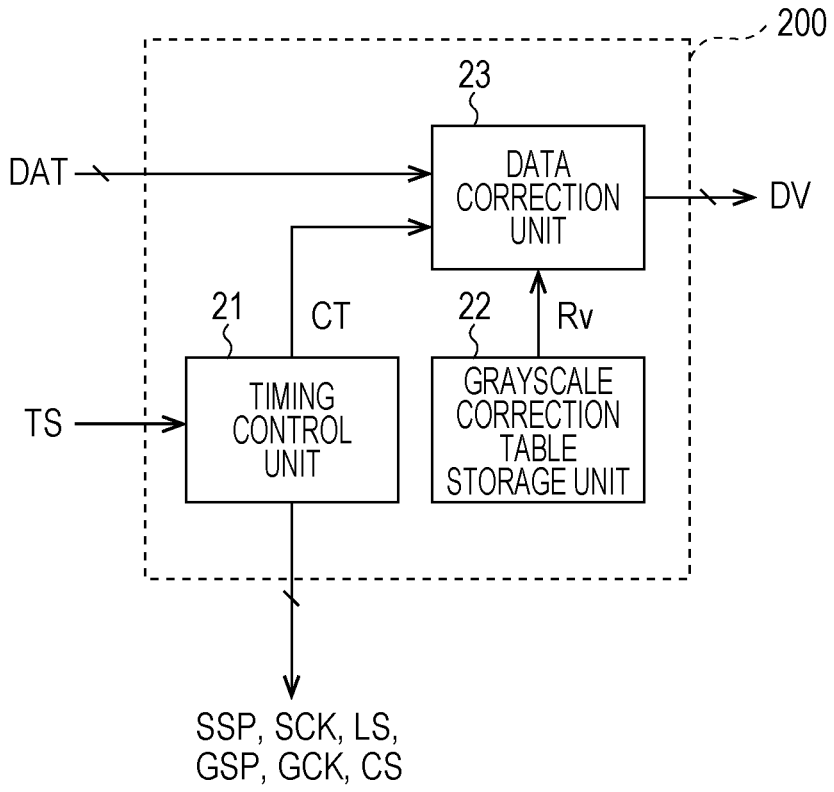
FIG. 4 is a block diagram illustrating the detailed structure of a display control circuit in the embodiment described above.

FIG. 4 is a block diagram illustrating the detailed structure of a display control circuit 200 in the present embodiment. This display control circuit 200 illustrated in FIG. 4 includes a timing control unit 21 that performs timing control, a grayscale correction table storage unit 22 that stores therein a grayscale reference voltage Rv which has been corrected for performing compensation suitable for prevention flickers and ghosting, and a data correction unit 23 that receives a pixel value (display grayscale data) included in the display data signal DAT given from the outside of the device to correct the received pixel value by performing calculation such that a grayscale voltage within a predetermined range changes based on the grayscale reference voltage Rv stored in the grayscale correction table storage unit 22. In other words, the correction described above naturally may be performed with a structure in which the pixel value before correction and the pixel value after correction of reference grayscale are stored in the form of a correspondence table or a structure in which a correction coefficient or other value is stored, not directly based on the grayscale voltage, for example.

Firstly, the timing control unit 21 illustrated in FIG. 4 receives the timing control signal TS sent from the outside and outputs a control signal CT for controlling the operation of the data correction unit 23, the source start pulse signal SSP for controlling the timing of causing the display 500 to display an image, the source clock signal SCK, the latch strobe signal LS, the gate start pulse signal GSP, the gate clock signal GCK, and the common potential control signal CS.

The grayscale correction table storage unit 22 stores therein data for converting the pixel value (display grayscale data) included in the display data signal DAT given to the data correction unit 23 into a pixel value suitable for prevention of flickers and ghosting, in the form of a lookup table (LUT) specifically. The contents of this LUT will be described with reference to FIGS. 5 and 6. It should be noted that although the grayscale voltage is mentioned here for the convenience of explanation, the correction may be performed in a manner not directly based on the grayscale voltage, as described above.

Figures 5, 6:
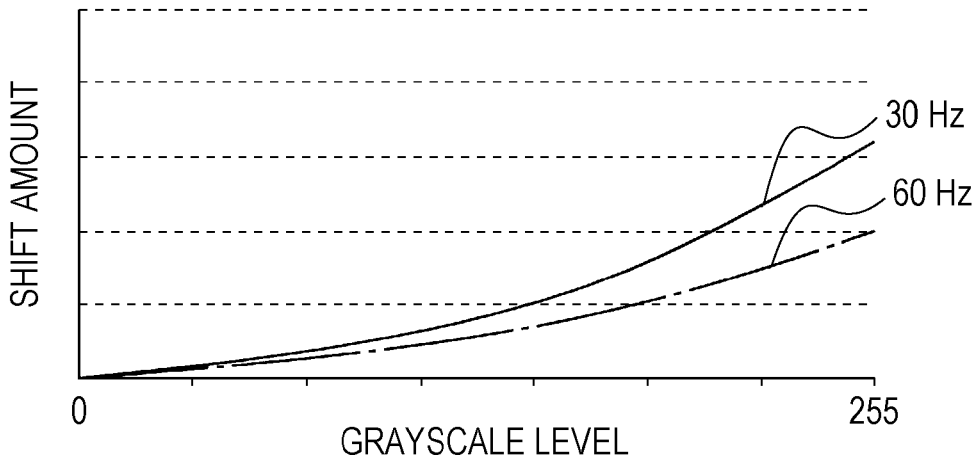
FIG. 5 is a diagram illustrating relation between a shift amount and a grayscale level (grayscale value) for each drive frequency in the embodiment described above.
FIG. 6 is a diagram illustrating relation between a grayscale reference voltage and a grayscale value set in the cases of drive frequencies of 30 [Hz] and 60 [Hz] as a lookup table in the embodiment described above.

FIG. 5 is a diagram illustrating relation between a shift amount and a grayscale level (grayscale value) for each drive frequency. This shift amount represents the correction amount for obtaining a pixel value suitable for prevention of flickers and ghosting and indicates the magnitude of the correction amount that is suitable for the corresponding grayscale level. Furthermore, the solid line in the figure indicates the relation described above in the case of driving at (a refresh frequency of) 30 [Hz], and the dashed line in the figure indicates the relation described above in the case of driving at 60 [Hz].

In the case of driving at 60 [Hz], a normal display operation is performed, and in the case of driving at 30 [Hz], a display operation is performed in a refresh timing which is slower than the normal timing. This operation is referred to as a low frequency drive method. This low frequency drive method is not suitable for display such as movie display because the display is driven at the frequency of 30 [Hz] which is lower than the frequency of 60 [Hz] at which flickers are not visible. However, the low frequency drive method can reduce power consumption of the device due to smaller energy loss caused by driving. Whether or not to drive with this low frequency drive method may be determined by the display control circuit 200 in accordance with a control signal from the outside the device or determined under the control under which an image determination unit included in the display control circuit 200 but not illustrated performs a normal display operation when the video signal is for a movie and performs low frequency drive when the video signal is for a still image. As described above, the display control circuit 200 functions as a drive frequency switching circuit. Furthermore, this switching circuit switches the lookup table described above.

As can be seen with reference to FIG. 5, when the drive frequency (refresh frequency) is 30 [Hz], compared with the case of 60 [Hz], the shift amount (correction amount) required for the compensation described above is large across the entire grayscale. Furthermore, compared with the case of 60 [Hz], the larger the grayscale level, the greater the difference with the shift amount in the case of 60 [Hz]. In other words, it can be said that the lower the drive frequency, the larger the change in the shift amount with respect to the grayscale level.

As described above, it can be said that the correction needs to be performed across the entire grayscale level to perform the compensation described above with high accuracy. However, this needs complicated and a large amount of correction, increasing the production cost of the device. For this reason, the structure as illustrated in FIG. 6 is also suitable in which the compensation described above is performed only in the vicinity of the highest value of the grayscale level with which the shift amount is the largest.

FIG. 6 is a diagram illustrating relation between the grayscale reference voltage and the grayscale value set in the cases of the drive frequencies of 30 [Hz] and 60 [Hz] as a lookup table. As illustrated in this FIG. 6, seven types of the grayscale reference voltages are used from V0 to V255 and cause different voltage values depending on whether the grayscale reference voltage is a positive polarity voltage or a negative polarity voltage. It should be noted that in this structure, the pixel values are corrected with reference to the grayscale reference voltages in the lookup table, for the convenience of explanation. However, the grayscale reference voltages do not need to be referred, as described above.

In the case of low frequency drive illustrated in FIG. 6 (the case of the drive frequency of 30 [Hz]), compared with the case of normal drive (the case of the drive frequency of 60 [Hz]), only voltage values corresponding to the highest grayscale reference voltage V255 of the positive polarity and the negative polarity and the next largest grayscale reference voltage V224 are different. With this structure, only at and in the vicinity of the largest value of the grayscale level with which the shift amount is the largest, the compensation described above can be performed.

In the structure, the data correction unit 23 illustrated in FIG. 6 described above may be omitted and the grayscale correction table storage unit 22 may give the grayscale reference voltage value to a grayscale reference voltage generation circuit which is not illustrated but present typically inside the source driver circuit 300. Furthermore, the display control circuit 200 or a circuit embedded therein may generate the grayscale reference voltage described above.

This grayscale reference voltage is given to the grayscale voltage generation circuit described above which is not illustrated and then divided, whereby an analog voltage corresponding to each display grayscale is generated. With this, the potential of the pixel electrode can be corrected without correction of the pixel value.

Naturally, the lookup table described above is merely an example. In the structure, a pixel grayscale value after correction or a grayscale voltage value may be retained for each grayscale, and as described later, the potential of the common electrode after correction may be retained.

The device that stores therein the lookup table, which is this grayscale correction table storage unit 22, may be any type of storage device. However, when a fixed and permanent value is written at the time of production, a ROM is suitable. When different values are written depending on the device at the time of production and values are rewritten, storage devices such as an EEPROM and a flash memory are suitable in which information is electrically erasable and the contents stored can be retained even when the power source is turned off.

As described above, when compensation suitable for prevention of flickers and ghosting is performed, the potentials of the pixel electrode and the common electrode may be set such that a DC voltage (direct current component) is not applied to the liquid crystal, that is, AC drive is correctly performed on the liquid crystal element. Accordingly, the pixel grayscale, that is, the voltage given to the source terminal of the TFT 10 as a data voltage may be corrected to an appropriate value as described above or the common potential may be corrected to an appropriate value. Detailed description will be made below how the compensation described above is performed in the case of the frame inversion drive method and in the case of the line inversion drive method with reference to FIGS. 7 to 11.

<3. Specific Operation>

Figure 7:
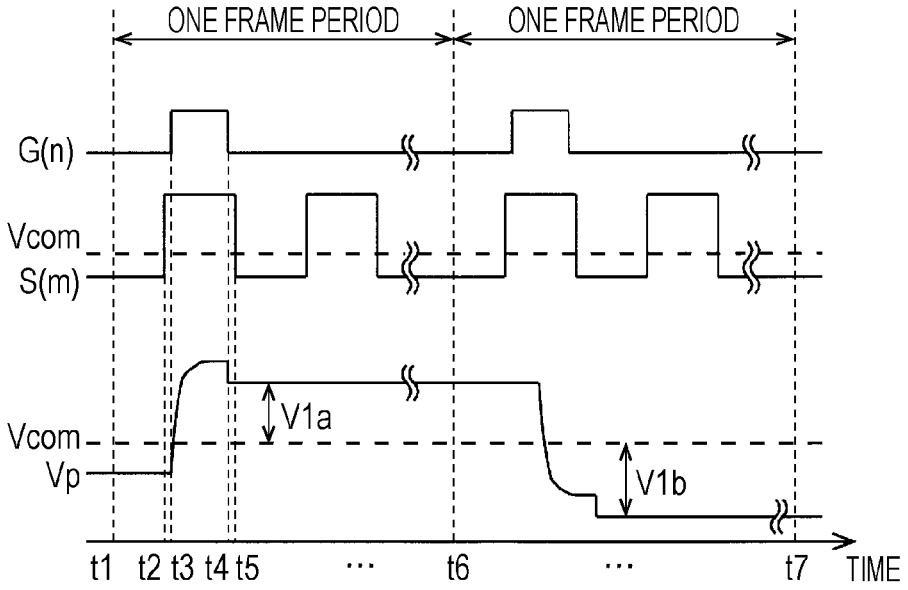
FIG. 7 is a diagram illustrating timings of various signals and potential change of a pixel electrode during normal display in the embodiment described above.

FIG. 7 is a diagram illustrating timings of various signals and potential change of the pixel electrode during normal display in the present embodiment. The gate driver circuit 400 repeats sequential outputs of active scanning signals G(1) to G(N) over one frame period. In FIG. 7, only the scanning signal G(n) is noted. Out of the frame periods starting from a time t1, the video signal S(m) noted here rises at a time t2. However, because the corresponding TFT 10 is not turned on, a pixel electrode potential Vp does not change. Thereafter, when the scanning signal G(n) rises at a time t3, the TFT 10 is turned on and the pixel electrode potential Vp rises until the charging is completed. However, when the scanning signal G(n) falls at a time t4, the pixel electrode potential Vp is pulled and also falls. Thereafter, the video signal S(m) falls at a time t5 and the pixel electrode potential Vp is fixed as is. At this point, when the potential difference between the common potential Vcom which is the potential of the common electrode illustrated in FIG. 7 and the fixed pixel electrode potential Vp is defined as Via and the potential difference between the common potential Vcom in the next frame and the fixed pixel electrode potential Vp is defined as V1*b*, the relation between V1*a* and V1*b* is set as V1*a*<V1*b*. With this setting, compensation suitable for prevention of flickers and ghosting can be performed.

Figure 8:
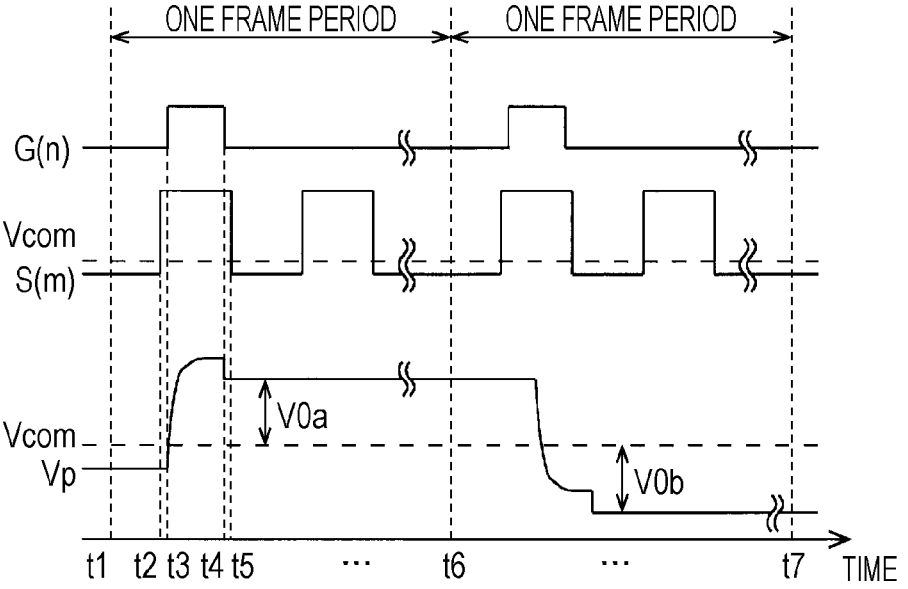
FIG. 8 is a diagram illustrating timings of various signals and potential change of a pixel electrode in a conventional device.

FIG. 8 is a diagram illustrating timings of various signals and potential change of the pixel electrode in a conventional device. As can be seen from this FIG. 8 when compared with FIG. 7, the waveforms therein are almost the same and only the voltage values thereof are different. More specifically, when the potential difference between the common potential Vcom illustrated in FIG. 8 and the fixed pixel electrode potential Vp is defined as V0*a* and the potential difference between the common potential Vcom in the next frame and the fixed pixel electrode potential Vp is defined as V0*b*, the relation between V0*a* and V0*b* is set as V0*a*=V0*b*. With this setting, compensation for prevention of flickers and ghosting cannot be performed.

Figure 9:
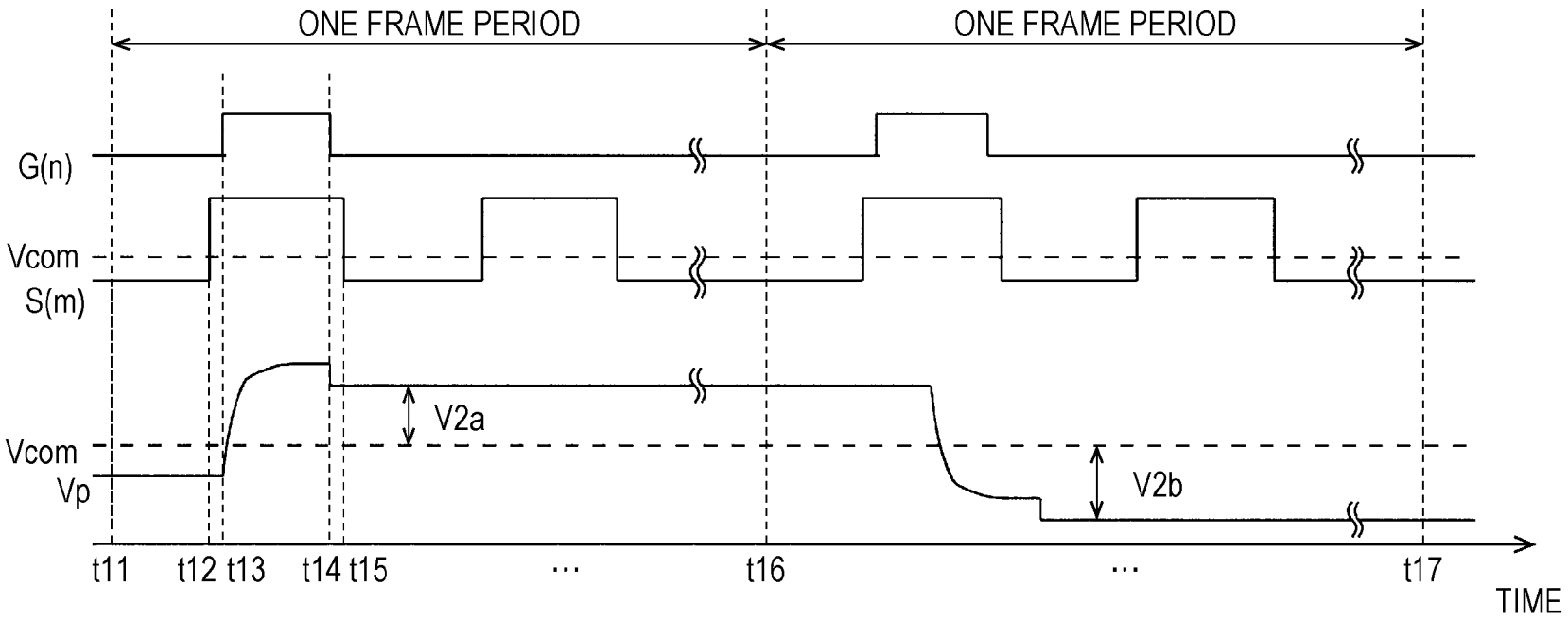
FIG. 9 is a diagram illustrating timings of various signals and potential change of a pixel electrode during low frequency drive in the embodiment described above.

FIG. 9 is a diagram illustrating timings of various signals and potential change of the pixel electrode during low frequency drive in the present embodiment. As can be seen from this FIG. 9 when compared with FIG. 7, the waveforms of various signals are extended to be twice as long as in FIG. 7 in the time direction. At this point, when the potential difference between the common potential Vcom which is the potential of the common electrode illustrated in FIG. 9 and the fixed pixel electrode potential Vp is defined as V2*a* and the potential difference between the common potential Vcom in the next frame and the fixed pixel electrode potential Vp is defined as V2*b*, the relation between V2*a* and V2*b* is set as V2*a*<V2*b*. With this setting, compensation suitable for prevention of flickers and ghosting can be performed. Furthermore, the relation between V1*a* and V1*b* illustrated in FIG. 7 can be represented by an inequality as in Equation (1) below.

$$(V1b-V1a)<(V2b-V2a) \quad (1)$$

More specifically, during low frequency drive compared with during normal drive, the differential value between the potential difference between the pixel electrode and the common electrode when a voltage of positive polarity is applied and the potential difference between the pixel electrode and the common electrode when a voltage of the negative polarity is applied is set larger. With this setting, as illustrated in FIG. 5, a shift amount can be larger during low frequency drive than during normal drive, whereby compensation can be performed that is suitable for prevention of flickers and ghosting during low frequency drive.

The description above indicates that when one pixel electrode is noted, pixel value correction may be performed as appropriate such that compensation is performed on the pixel value given to that pixel electrode. However, when all the pixel electrodes are noted, it is indicated that in addition to pixel value correction, correction of the value of the common potential Vcom may be included in the structure. The common electrode drive circuit 600 thus may generate a common potential Vcom that satisfies Equation (1) above.

Furthermore, from FIG. 7 to FIG. 9, aspects in the case of frame inversion drive are illustrated. However, exactly the same applies to the case of line inversion drive. This will be described below with reference to FIGS. 10 and 11.

Figure 10:
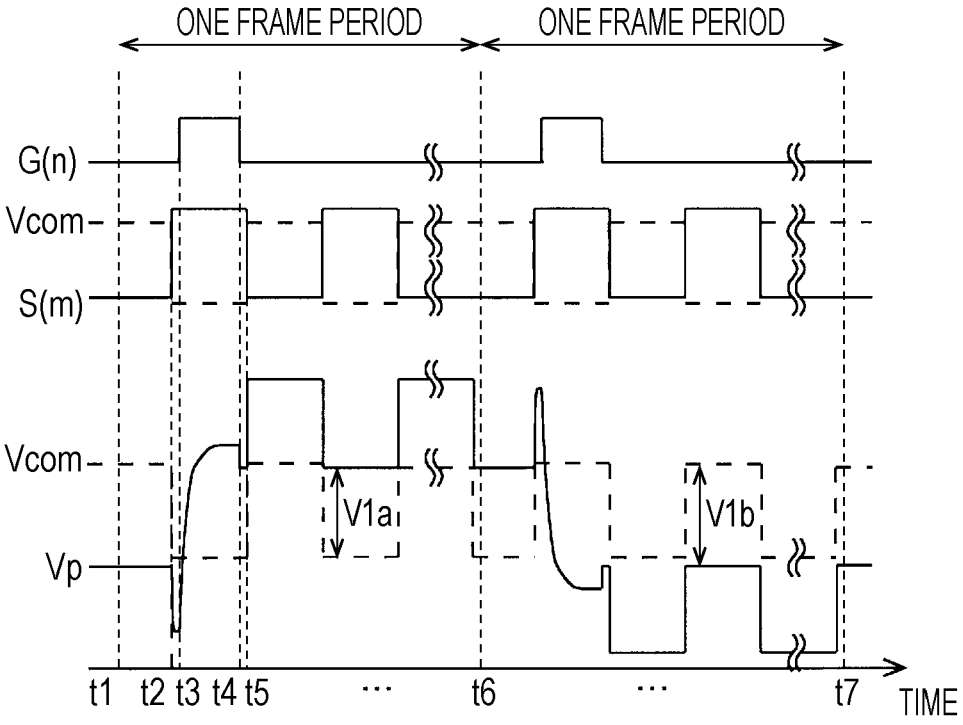
FIG. 10 is a diagram illustrating timings of various signals and potential change of a pixel electrode during normal display in the case of line inversion drive in the embodiment described above.

FIG. 10 is a diagram illustrating timings of various signals and potential change of the pixel electrode during normal display in the case of line inversion drive. In FIG. 10, out of the frame periods starting from the time t1, the video signal S(m) noted here rises at the time t2. However, because the corresponding TFT 10 is not turned on, the potential thereof is not given to the pixel electrode potential Vp. However, because the common potential Vcom falls at the time t2, the pixel electrode potential Vp falls similarly. Thereafter, when the scanning signal G(n) rises at the time t3, the TFT 10 is turned on and the pixel electrode potential Vp rises until the charging is completed. However, when the scanning signal G(n) falls at the time t4, the pixel electrode potential Vp is pulled and also falls. Thereafter, the video signal S(m) falls at the time t5 and the pixel electrode potential Vp is fixed as is. At the same time, the common potential Vcom rises, and thus the pixel electrode potential Vp rises similarly. In accordance with the change of the common potential Vcom, the pixel electrode potential Vp similarly changes. At this point, as in the case of FIG. 7, when the potential difference between the common potential Vcom illustrated in FIG. 10 and the pixel electrode potential Vp is defined as Via and the potential difference between the common potential Vcom in the next frame and the pixel electrode potential Vp is defined as V1*b*, the relation between V1*a* and V1*b* is set as V1*a*<V1*b*. With this setting, compensation suitable for prevention of flickers and ghosting can be performed.

Figure 11:
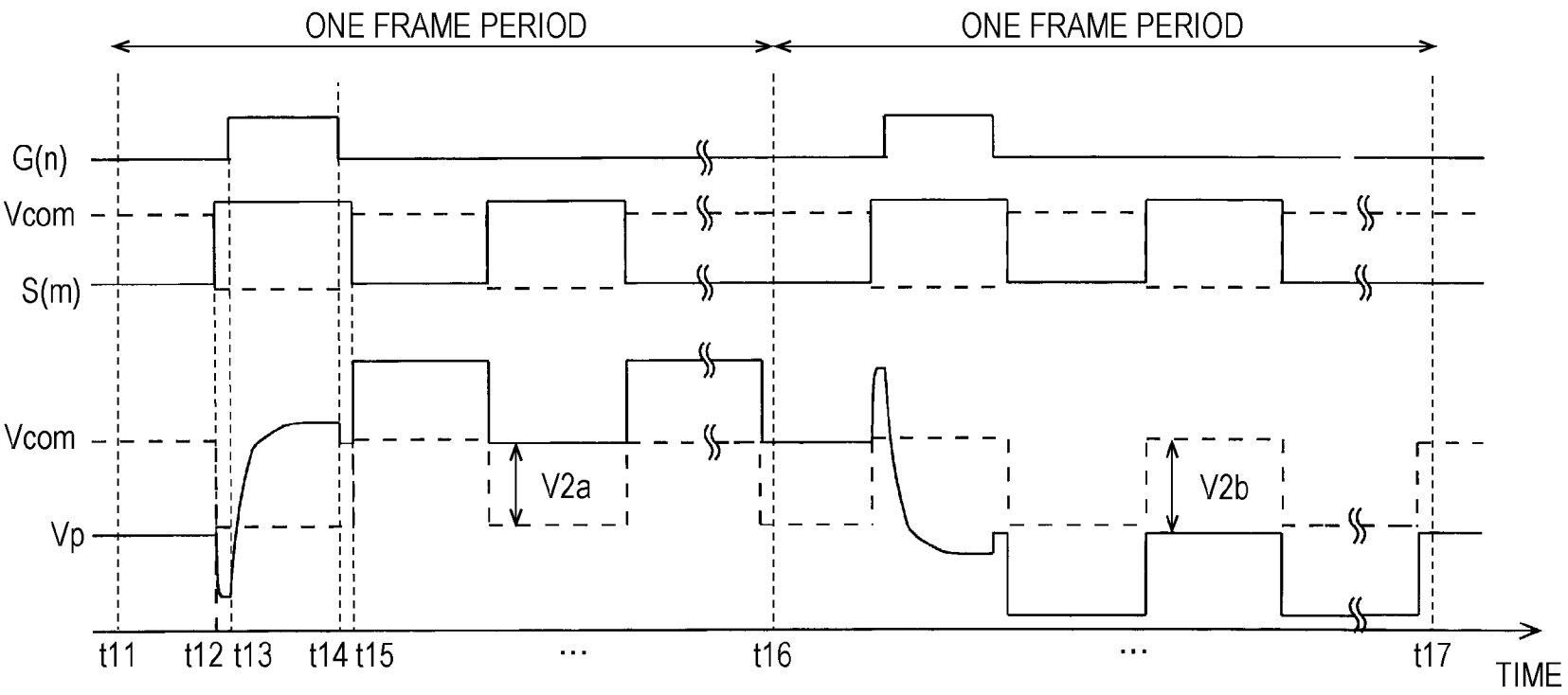
FIG. 11 is a diagram illustrating timings of various signals and potential change of a pixel electrode during low frequency drive in the case of line inversion drive in the embodiment described above.

FIG. 11 is a diagram illustrating timings of various signals and potential change of a pixel electrode during low frequency drive in the case of line inversion drive. As can be seen from this FIG. 11 when compared with FIG. 10, the waveforms of various signals are extended to be twice as long as in FIG. 10 in the time direction, similarly in the description made with reference to FIG. 9. In other words, Equation (1) above is established similarly.

<4. Effect>

As described above, in the present embodiment, during low frequency drive compared with during normal drive, the differential value between the potential difference between the pixel electrode and the common electrode when a voltage of positive polarity is applied and the potential difference between the pixel electrode and the common electrode when a voltage of the negative polarity is applied is set larger. With this, a correction amount (shift amount) can be larger during low frequency drive than during normal drive, whereby compensation can be performed that is suitable for prevention of flickers and ghosting during low frequency drive.

The effect described above is increased when a display using a transverse field method such as the IPS mode and the FFS mode than in the case of the TN mode, as described above. Furthermore, in a structure in which an oxide semiconductor is used in the semiconductor layer of the TFT 10, the effect is increased similarly. This will be described with reference to FIG. 12.

Figure 12:
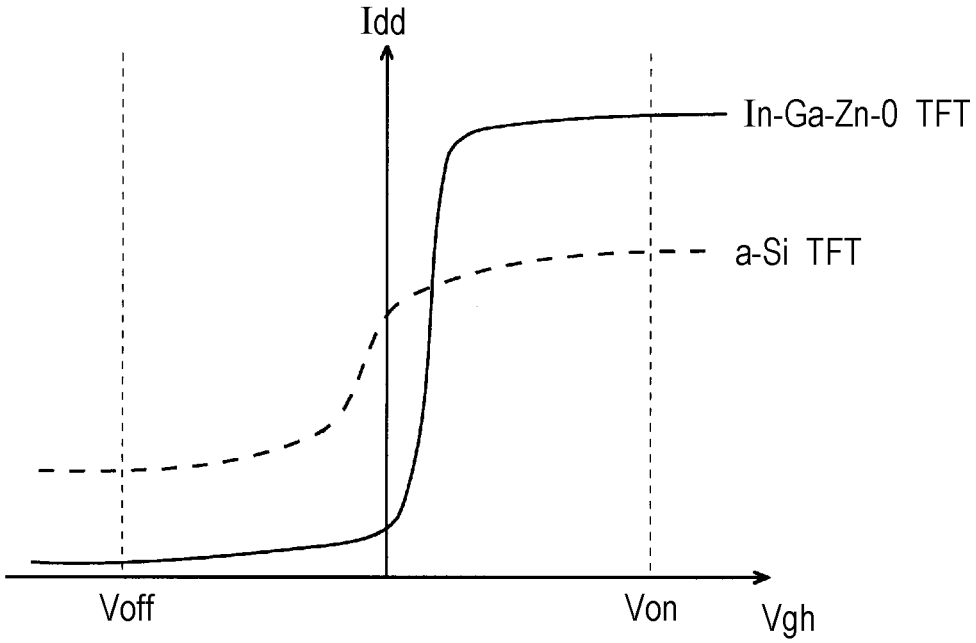
FIG. 12 is a diagram illustrating a characteristic of an oxide semiconductor (In—Ga—Zn—O) TFT and an amorphous silicon (a-Si) TFT in the embodiment described above.

FIG. 12 is a diagram illustrating a characteristic of an oxide semiconductor (In—Ga—Zn—O) TFT and an amorphous silicon (a-Si) TFT. As illustrated in FIG. 12, the off-leak characteristic of the oxide semiconductor (In—Ga—Zn—O) TFT is approximately 100 times better than that of the amorphous silicon (a-Si) TFT and hardly causes flickers due to a current leakage. For this reason, no flicker measures are taken, which is why defects due to other factors such as ghosting described above are easily caused, by contrast. The effect described above is thus more prominent when the oxide semiconductor (In—Ga—Zn—O) TFT is used.

INDUSTRIAL APPLICABILITY

The present invention is applied to an active matrix type of display device, and especially suitable for a mobile terminal and other devices using a display device that can be driven at a low frequency lower than 60 Hz.

REFERENCE SIGNS LIST

10 TFT (switching element)
21 timing control unit
22 grayscale correction table storage unit
23 data correction unit
200 display control circuit
300 source driver circuit
400 gate driver circuit
500 display
600 common electrode drive circuit
DAT display data signal (image signal)
DV digital image signal
CS common potential control signal
Clc liquid crystal capacitor (pixel capacitor)
Ccs auxiliary capacitor
Ecom common electrode
Epix pixel electrode
GL(n) scanning signal line (n=1 to N)

SL(m) data signal line (m=1 to M)

P(n,m) pixel forming unit (n=1 to N, m=1 to M)

The invention claimed is:

1. An active matrix type of display device including a plurality of pixels that form an image to be displayed and include a pixel electrode and a common electrode provided in a manner corresponding to the pixel electrode to apply a voltage between the pixel electrode and the common electrode, a plurality of video signal lines for communicating a plurality of video signals indicating the image to be displayed to the plurality of pixels, and a plurality of scanning signal lines crossing the video signal lines, the plurality of pixels associated with the video signal lines and the scanning signal lines and disposed in a matrix, the display device comprising:

a scanning signal line drive circuit that selectively drives the scanning signal lines;

a video signal line drive circuit that transmits the video signals to be communicated to the video signal lines;

a common electrode drive circuit that sets a voltage to be applied to the common electrode; and a display control circuit that controls the scanning signal line drive circuit, the video signal line drive circuit, and the common electrode drive circuit by transmitting a predetermined control signal thereto, wherein the display control circuit controls the video signal line drive circuit and the common electrode drive circuit such that a polarity of a voltage applied to the pixel electrode based on a potential of the common electrode as a reference is inverted for each predetermined period and a differential value between a potential difference between the pixel electrode and the common electrode when a voltage of positive polarity is applied and the potential difference between the pixel electrode and the common electrode when a voltage of negative polarity is applied is set larger when the image to be displayed is rewritten in a frame period having a second length longer than a first length than when the image to be displayed is rewritten in a frame period having the first length.

2. The display device according to claim 1, wherein the display control circuit controls the common electrode drive circuit such that a voltage of the common electrode is adjusted such that the differential value becomes larger when the common electrode is driven with the second length than when the common electrode is driven with the first length.

3. The display device according to claim 1, wherein the display control circuit controls the video signal line drive circuit such that a voltage applied to the pixel electrode is adjusted such that the differential value becomes larger when the video signal line is driven with the second length than when the video signal line is driven with the first length.

4. The display device according to claim 3, wherein the display control circuit controls the video signal line drive circuit such that a voltage applied to the pixel electrode is adjusted such that the differential value becomes larger in the vicinity of a highest value of display grayscale indicated by the video signal.

5. The display device according to claim 3, wherein the display control circuit controls the video signal line drive circuit such that a voltage applied to the pixel electrode is adjusted such that the larger display grayscale indicated by the video signal, the larger the differential value.

6. The display device according to claim 3, wherein the display control circuit stores therein an adjustment amount for adjusting a voltage applied to the pixel electrode as table information associated with display grayscale corresponding to the video signal.

7. The display device according to claim 3, wherein the display control circuit includes a drive frequency switching circuit that switches between a first case rewriting the image to be displayed in a frame period having the first length and a second case rewriting the image to be displayed in a frame period having the second length, wherein the table information includes first table information storing therein the adjustment amount in the first case and second table information storing therein the adjustment amount in the second case.

8. The display device according to claim 1, wherein each of the pixels of the plurality of pixels includes a thin film transistor that is brought into a conductive state or an interrupted state in accordance with a signal applied to a scanning signal line connected thereto, a pixel electrode connected to a video signal line connected thereto via the thin film transistor, a pixel capacitor formed by the pixel electrode and the common electrode, and a liquid crystal element that displays a pixel in display grayscale in accordance with a voltage retained by the pixel capacitor.

9. The display device according to claim 8, wherein the thin film transistor includes a semiconductor layer consisting of an oxide semiconductor.

10. The display device according to claim 9, wherein the oxide semiconductor contains indium, gallium, and zinc as principal components.

11. The display device according to claim 8, wherein in the plurality of pixels, the pixel electrode and the common electrode are disposed so as to be in a liquid crystal mode of a transverse field method with respect to the liquid crystal element.

12. An electronic device comprising the display device according to claim 1.

13. The display device according to claim 1, wherein the differential value is different only at and in the vicinity of a highest value of display grayscale level indicated by the video signal.

14. A method of driving an active matrix type of display device including a plurality of pixels that form an image to be displayed and include a pixel electrode and a common electrode provided in a manner corresponding to the pixel electrode to apply a voltage between the pixel electrode and the common electrode, a plurality of video signal lines for communicating a plurality of video signals indicating the image to be displayed to the plurality of pixels, and a plurality of scanning signal lines crossing the video signal lines, the plurality of pixels associated with the video signal lines and the scanning signal lines and disposed in a matrix, the method comprising:

selectively driving the scanning signal lines;

transmitting the video signals to be communicated to the video signal lines;

setting a voltage to be applied to the common electrode; and controlling the driving the scanning signal lines, the transmitting the video signals, and the setting the voltage to be applied to the common electrode by transmitting a predetermined control signal thereto, wherein the controlling the driving the scanning signal lines controls the transmitting the video signals and the setting the voltage to be applied to the common electrode such that a polarity of a voltage applied to the pixel electrode based on a potential of the common electrode as a reference is inverted for each predetermined period and a differential value between a potential difference between the pixel electrode and the common electrode when a voltage of positive polarity is applied and the potential difference between the pixel electrode and the common electrode when a voltage of negative polarity is applied is set larger when the image to be displayed is rewritten in a frame period having a second length longer than a first length than when the image to be displayed is rewritten in a frame period having the first length.

* * * * *